United States Patent [19]

Woicke

[11] 4,361,146

[45] Nov. 30, 1982

[54] FILTERING RESPIRATOR

[75] Inventor: Bernd Woicke, Berlin, Fed. Rep. of Germany

[73] Assignee: Auergesellschaft GmbH, Berlin, Fed. Rep. of Germany

[21] Appl. No.: 188,337

[22] Filed: Sep. 18, 1980

[30] Foreign Application Priority Data

Sep. 21, 1979 [DE] Fed. Rep. of Germany ..... 2938726

[51] Int. Cl.[3] ..... A62B 7/10

[52] U.S. Cl. ..... 128/206.12; 128/206.16

[58] Field of Search ..... 128/206.12, 206.16, 128/206.17, 206.15

[56] References Cited

U.S. PATENT DOCUMENTS

| | | | |
|---|---|---|---|
| 609,923 | 8/1898 | Tuttle | 128/203.29 |
| 831,623 | 9/1906 | Murphy | 128/203.29 |
| 2,067,026 | 1/1937 | Schwartz | 128/206.12 |
| 2,417,759 | 3/1947 | Johnson | 128/206.22 |
| 2,681,060 | 6/1954 | Swindell | 128/206.12 |

FOREIGN PATENT DOCUMENTS

| | | | |
|---|---|---|---|
| 1341294 | 9/1963 | France | 128/206.12 |
| 21600 | of 1907 | United Kingdom | 128/203.29 |

*Primary Examiner*—Henry J. Recla

*Attorney, Agent, or Firm*—Carothers and Carothers

[57] ABSTRACT

A filtering respirator in the form of a mask has an outer casing and a filter layer inside the casing. The edge of the filter liner is sealed to the casing and the rest of the filter layer is spaced from the casing to provide an interspace between them which is connected with the outside atmosphere by an opening in the casing so that exhaled air will leave the mask at a velocity sufficient to prevent inhaling of the exhaled air.

1 Claim, 2 Drawing Figures

FILTERING RESPIRATOR

A filtering respirator is known that takes the form of a half mask, in which the outer casing that covers the wearer's mouth and nose is provided with an exchangeable filter that covers the inside of the casing, the arrangement being such that retainers on the casing's periphery press the filter snugly against the inner surface of the casing. A number of breathing holes are distributed over the entire surface of the casing to ensure that the intake and output of air are not concentrated in a limited area of the mask. The inhaled air is drawn in through the breathing holes in the casing and then through the filter material directly into the mouth-nose-region, while the exhaled air travels in the reverse direction through the filter material and the casing back into the surrounding atmosphere.

With this form of construction, and with other known types of commercially obtainable filtering masks, a fundamental drawback is that the exhaled air close to the outside of the mask envelops the outer casing so that, on inhaling, warm carbon dioxide and exhaled air containing water vapor are re-inhaled. As a result, the respirator wearer's breathing comfort and the operational efficiency of the respirator are appreciably impaired.

On the other hand, filtering respirators with an extensive separation of the inhaled and exhaled air have until now been unknown.

It is among the objects of this invention to provide a filtering respirator with which the carbon dioxide concentration in the inhaled air is reduced to a tolerable and, from a medical point of view, acceptable level, and which is simple and inexpensive in construction.

The advantages to be gained by means of this invention reside, in particular, in the fact that the exhaled air that flows away from the entire area of the filter layer is conducted through the casing and away from the mask to the surrounding outside atmosphere in such a way that, on inhaling, almost no exhaled air is inhaled. Moreover, an additional advantage resides in the fact that the sought-for extensive separation of the exhaled air from the inhaled air is achieved without the use of mechanically actuated components such as, for example, respiration valves, so that the manufacture of respirators made in accordance with this invention is extremely simple and cost-favorable.

Figure 1:
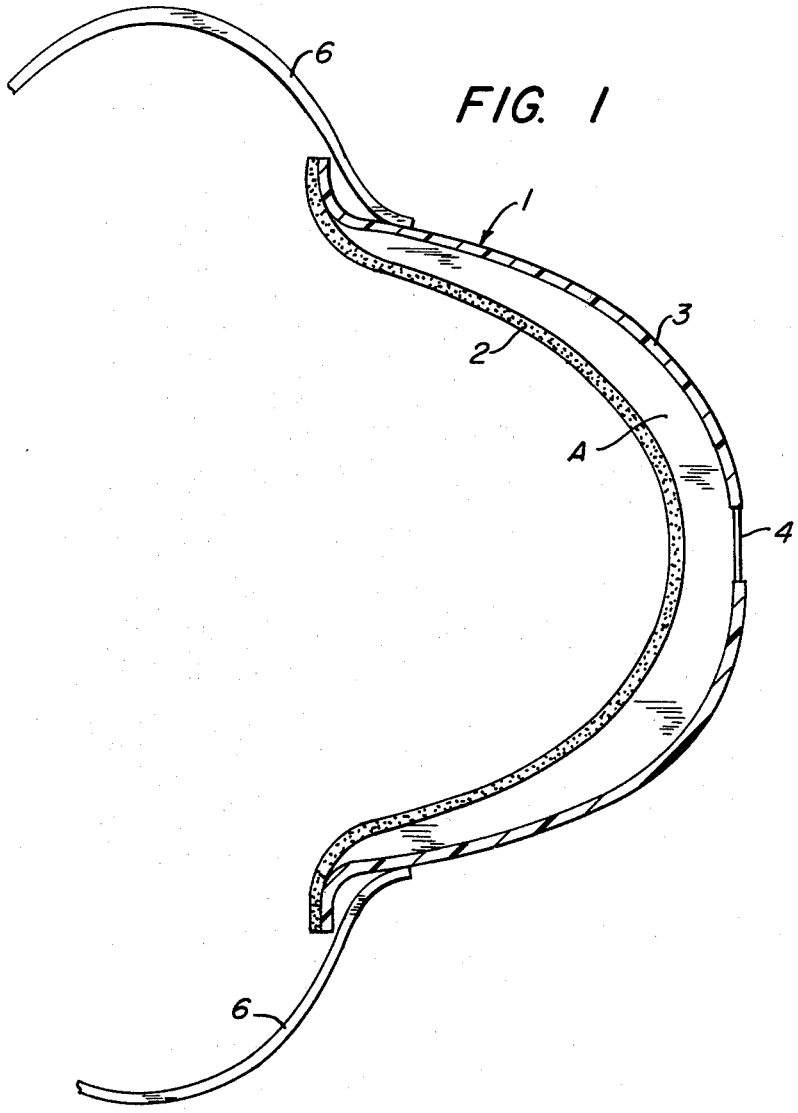
Figure 2:
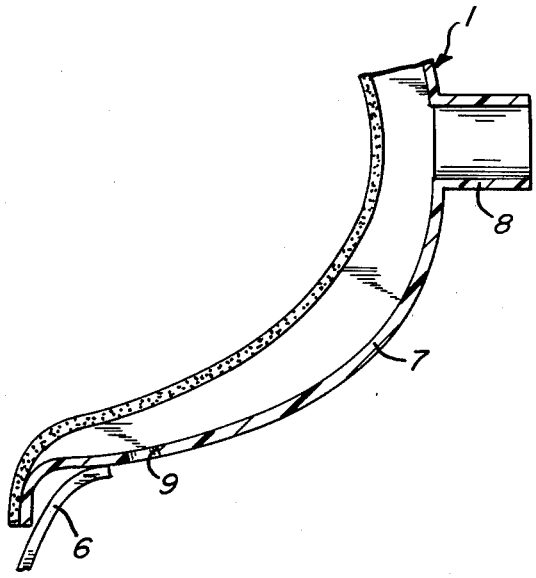

The preferred embodiment of the invention is illustrated in the accompanying drawings, in which FIG. 1 is a horizontal section through a half mask; and FIG. 2 is a fragmentary section through a modification.

As may be seen from FIG. 1, the respirator mask 1 consists, in essence, of an internal filtering mask 2 that fits snugly around the nose and mouth areas of the wearer and that is made from a filter layer, and an outer casing 3 of air-impervious material that constitutes the outside mask. It can be made of plastic, hard-foam material, air-impervious cardboard or rubber. The outer casing and the filter layer are secured together at their edges, either permanently or replaceably, to form a seal. In the latter case, the periphery of the outer casing can be made in the form of a gasket (not shown) that encloses and engages the periphery of the filter layer. The outer casing 3 is advantageously made in the form of a wearable, inherently stable part and thus also constitutes an external protection for the respirator.

In accordance with this invention, casing 3 is made in such a way and so placed over the filter layer 2 that an interspace A is produced. In the center of the casing there is a respiration opening 4, which is suitably dimensioned to allow the exhaled carbon dioxide and water vapor containing air to be blown away from the mask as a jet stream with sufficient velocity so that during subsequent inhaling the exhaled air will not be re-inhaled. To hold the mask in place, it is provided with head straps 6 attached to casing 3.

If desired, as shown in FIG. 2, the respiration opening in the outer casing 7 can be made in the form of a tube 8. In addition, whether or not a tube is used a limited number of respiration openings 9 of any arbitrary geometrical shape can by symmetrically or otherwise distributed around the periphery of the outer casing as also shown in FIG. 2. The size and number of these additional openings 9 must not be so great as to prevent exhaled air from being blown away from the mask with sufficient velocity to accomplish the purpose of this invention.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A filtering respirator comprising a mask for protecting the breathing passages of a user from contaminated environmental atmosphere, the mask being formed from a casing of air-impervious material adapted to fit around the nose and mouth areas, and a filter sheet inside said casing also large enough to fit around the nose and mouth areas and sealed at its periphery to the casing, the rest of the filter sheet being spaced inwardly from the casing to form an interspace between time, and said casing being provided with only one respiration opening therethrough spaced outwardly from said filter sheet and connecting said interspace with the ambient atmosphere surrounding the mask, for inhalation and exhalation, said opening being located centrally of the casing and having a size small enough to produce a jet stream of exhaled air of sufficient velocity to carry that air away from the mask far enough to prevent it from being inhaled during the next inhalation.

* * * * *